US007024713B2

(12) United States Patent
Ambuhl

(10) Patent No.: US 7,024,713 B2
(45) Date of Patent: Apr. 11, 2006

(54) SEAT CUSHION

(75) Inventor: Peter Ambuhl, Wettswill (CH)

(73) Assignee: Sissel Handels GmbH, Bregenz (AT)

( * ) Notice: Subject to any disclaimer, the term of this patent is extended or adjusted under 35 U.S.C. 154(b) by 0 days.

(21) Appl. No.: 10/964,786

(22) Filed: Oct. 15, 2004

(65) Prior Publication Data

US 2005/0082887 A1 Apr. 21, 2005

(30) Foreign Application Priority Data

Oct. 16, 2003 (AT) ..... GM714/2003

(51) Int. Cl.
*A47C 16/00* (2006.01)

(52) U.S. Cl. ..... 5/654; 5/653; 297/452.23

(58) Field of Classification Search ..... 297/452.21, 297/452.23, 452.25, 452.26; 5/653–654
See application file for complete search history.

(56) References Cited

U.S. PATENT DOCUMENTS

| | | | | |
|---|---|---|---|---|
| 3,222,694 A | * | 12/1965 | Schick | 5/653 |
| 3,382,511 A | * | 5/1968 | Brooks | 5/652 |
| 4,923,247 A | * | 5/1990 | Malmstrom | 297/4 |
| 5,634,223 A | | 6/1997 | Obermaier | |
| 5,845,352 A | | 12/1998 | Matsler | |
| 6,012,188 A | | 1/2000 | Daniels | |
| 6,413,194 B1 | * | 7/2002 | Gant | 482/112 |
| 6,581,227 B1 | | 6/2003 | Obermaier | |

FOREIGN PATENT DOCUMENTS

| | | |
|---|---|---|
| DE | 296 22 187 | 3/1997 |
| EP | 1 342 434 A2 | 9/2003 |
| WO | WO 2003/079858 | 10/2003 |

* cited by examiner

*Primary Examiner*—Michael Trettel
(74) *Attorney, Agent, or Firm*—Young & Thompson

(57) ABSTRACT

A seat cushion (1) with a seat surface wall area (3) and with a bottom surface wall area (5) has a bead-shaped transition wall area (5) which joins the seat surface wall area (3) to the bottom surface wall area (5). Thus, there is a fluid-tight cushion (1) which can be filled with air via a sealable fill opening, In two areas (11) which are adjacent with a distance from one another the distance of the transition wall area (7) from the middle (19) of the seat cushion (1) is increased, by which in an overhead view lens-shaped areas (11) are formed which project laterally over the essentially circular outline shape of the seat cushion (1) which is otherwise determined by the transition wall area (7). These projecting areas (11) are supports for the thighs (17) of an individual (17) sitting on the seat cushion (1). Even for a small diameter of the generally circular surface-shaped seat cushion (1) this yields good sitting comfort, since the thighs (13) are supported at least in the area adjoining the buttocks (15) by the projecting supports (11), as would be otherwise only for a seat cushion with an altogether larger diameter.

12 Claims, 2 Drawing Sheets

SEAT CUSHION

FIELD OF THE INVENTION

The invention relates to a seat cushion with the features of the introductory part of claim 1.

BACKGROUND OF THE INVENTION

Such a seat cushion is known from DE-U-296 22 187.

Similar seat cushions are known from U.S. Pat. No. 5,634,223 or EP-B-0 705 549.

The disadvantage in the known, essentially round seat cushions is that for the user of the seat cushion when sitting on it they have only inadequate support especially for the thighs of the user if they do not have a correspondingly large diameter and project into the area of the thighs of the user.

SUMMARY OF THE INVENTION

The object of the invention is to provide a seat cushion which does not have this disadvantage.

This object is achieved as claimed in the invention with a seat cushion which has the claimed features.

Preferred and advantageous embodiments of the seat cushion as claimed in the invention are the subject matter of the dependent claims.

By the measure of making the transition wall area in two areas with a greater distance from the middle of the seat cushion "ear-like" projections of the seat cushion are formed which can be used as supports for the thighs of an individual sitting on the seat cushion. The seat cushion as claimed in the invention accordingly also offers support areas for the thighs of the user when the seat cushion is made otherwise with a diameter which offers a large enough seating surface for the buttocks of the user.

Other details, features and advantages of the seat cushion as claimed in the invention derive from the following description of preferred embodiments using the drawings.

BRIEF DESCRIPTION OF THE DRAWINGS

FIG. 3*b* shows the seat cushion in a side view and viewed from underneath FIG. 3*a.

DETAILED DESCRIPTION OF THE INVENTION

Figure 1:
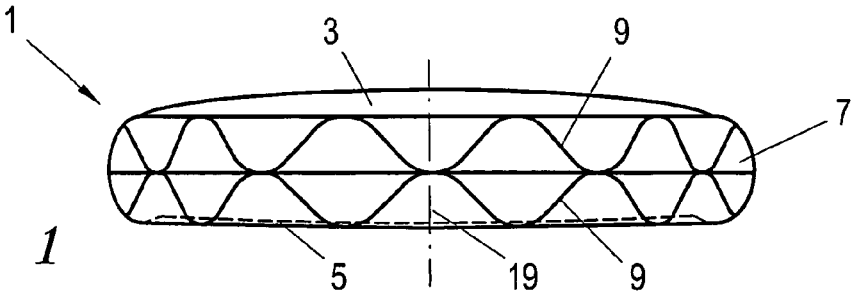
FIG. 1 shows a seat cushion as claimed in the invention in a side view.

The seat cushion 1 as claimed in the invention, as is shown in the embodiment, consists preferably of soft-elastic material, especially soft-elastic plastic film which has for example rubber-elastic properties.

In the embodiment shown, the seat cushion 1 consists of a seating surface wall area 3 which is essentially round, a likewise round bottom surface wall area 5 which is essentially the same size, and a transition wall area 7. The transition wall area 7 joins the seat surface wall area 3 to the bottom surface wall area 5 with the formation of a bead which preferably has a semicircular cross sectional shape.

As is shown in the embodiment, the transition wall area 7 on its outer side can be made with wavy ornamental and/or reinforcing lines 9, for example in the form of projecting ribs.

It is also shown that when the seat cushion 1 is exposed to a load the seat surface wall area 3 and the bottom surface wall area 5 are convex, the convexity of the seat surface wall area 3 being greater than that of the bottom surface wall area 5.

Figure 2B:
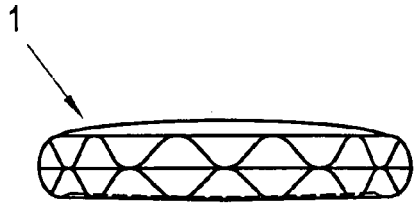
FIG. 2*b* shows the seat cushion in a side view and viewed from underneath FIG. 2*a;*
Figure 3B:
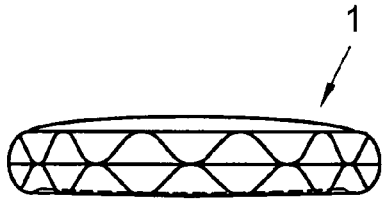
Figure 2A:
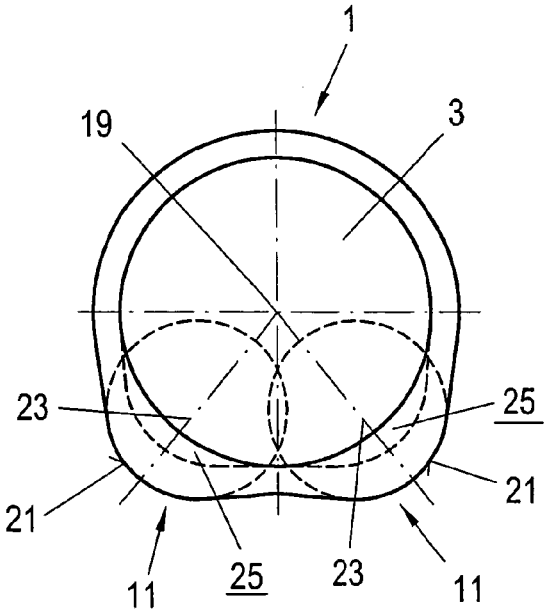
FIG. 2*a* shows the seat cushion in an overhead view.
Figure 3A:
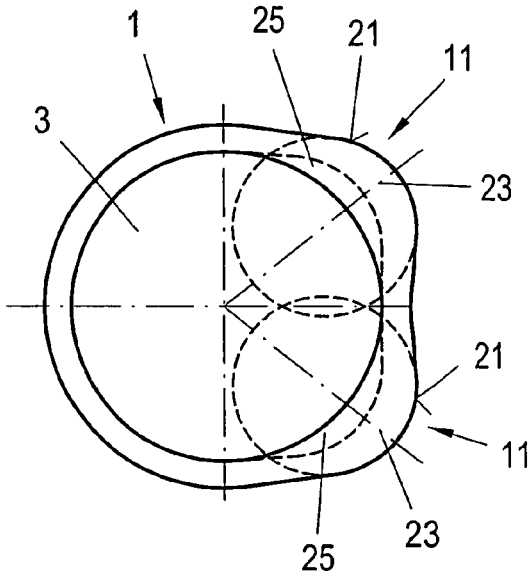
FIG. 3*a* shows the seat cushion in an overhead view.

As can be taken especially from FIGS. 2*a* and 3*a*, the seat cushion as claimed in the invention has two areas 11 which are used as supports for the thighs 13, especially in their segments which border the buttocks 15 of a user 17. The areas 11 are formed first of all by the transition wall area 7 which has a greater distance there from the middle 19 of the seat cushion 1. As shown by FIGS. 2*b* and 3*b*, the outside shape 21 of the transition wall area 7 in the area of the supports 11 for the thighs 13 of the individual 17 sitting on the seat cushion 1 is for the most part that of a circular arc (symbolized by the depicted circles).

It is such that the areas 11 which form the two supports have a distance from one another. The distance of the transition wall area 7 from the middle 19 of the seat cushion 1 increases in the area 11 of the supports as far as the middle plane 23 of each area 11, and this increase of distance can always be continuous.

The bottom surface wall area 5 of the seat cushion 1 as claimed in the invention, with the seat cushion 1 unloaded, therefore when there is no individual 17 sitting on it, is arranged offset relative to the lowest area of the edge bead which is formed by the transition wall area 7 to the inside, therefore toward the horizontal center plane of the seat cushion 1. This is shown especially by FIGS. 1, 2*a* and 3*a*.

Figure 4:
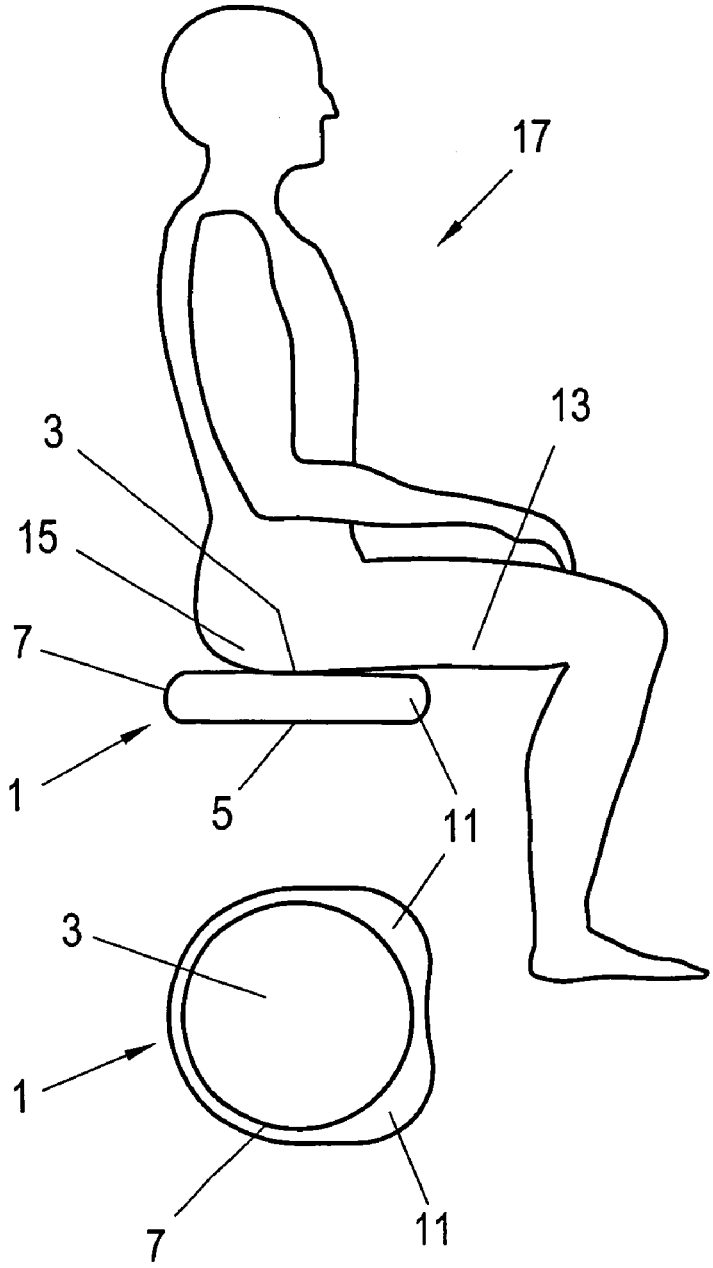
* and FIG. 4 shows the seat cushion viewed from the side with an individual sitting on it, the alignment of the seat cushion being shown by the overhead view shown in FIG. 4.

When the seat cushion 1 is being used for sitting, it is aligned such that the ear-shaped areas 11 which form the supports are located underneath the thighs 13 of the user 17, as is shown symbolically in FIG. 4.

The wall areas 25 between the seat surface wall area 3 and between the bottom surface wall area 5 and the edge bead which is formed by the transition wall area 7 are made essentially (moon-) sickle-shaped in the areas 11, and with the seat cushion 1 unloaded, essentially flat. In this way, especially joined to the seat surface wall area 3 good supports for the thighs 13 on an individual 17 sitting on the seat cushion 1 are formed.

In summary, one embodiment of the invention can be described as follows:

A seat cushion 1 with a seat surface wall area 3 and a bottom surface wall area 5 has a bead-shaped transition wall area 7 which connects the seat surface wall area 3 to the transition wall area 7. Thus, there is a fluid-tight cushion 1 which can be filled with air via a sealable fill opening. In two areas 11 which are adjacent with a distance from one another the distance of the transition wall area 7 from the middle 19 of the seat cushion 1 is increased, by which in an overhead view lens-shaped areas 11 are formed which project laterally over the essentially circular outline shape of the seat cushion 1 which is otherwise determined by the transition wall area 7. These projecting areas 11 are supports for the thighs 17 of an individual 17 sitting on the seat cushion 1. Even for a small diameter of the generally circular surface-shaped seat cushion 1 this yields good sitting comfort, since the thighs 13 are supported at least in the area adjoining the buttocks 15 by the projecting supports 11, as would be otherwise only for a seat cushion with an overall larger diameter.

The invention claimed is:

1. A seat cushion comprising:

an essentially round seat surface wall area;

an essentially round bottom surface wall area;

a bead-shaped transition wall area which connects the seat surface wall area to the bottom surface wall area, and is located therebetween to form a fluid-tight, rubber-elastic hollow body;

the transition wall area having a semicircular cross sectional shape, and two projecting areas which are used as supports for the thighs of an individual using the seat cushion; and the transition wall area being essentially equidistant from the middle of the seat cushion, except in the areas of each support, where the distance to the middle of the cushion is greater.

2. The seat cushion according to claim 1, wherein the supports are arranged with a distance from one another.

3. The seat cushion according to claim 1, wherein the distance of the transition wall area from the middle of the seat cushion increases in the area of the supports from two sides up to a maximum in the middle of the supports.

4. The seat cushion according to claim 1, wherein each support has a middle plane, and a projecting outer contour which is essentially circular arc-shaped at least in the area on either side of the middle plane.

5. The seat cushion according to claim 1, wherein the seat surface wall area in an unloaded state of the seat cushion is convexly arched.

6. The seat cushion according to claim 1, wherein the seat surface wall area in the area of the supports is elongated by flat, sickle-shaped wall areas toward the transition wall area.

7. The seat cushion according to claim 1, wherein the bottom surface wall area in an unloaded state of the seat cushion is inwardly offset toward a horizontal center plane of the seat cushion, relative to the transition wall area.

8. The seat cushion according to claim 5, wherein the bottom surface wall area is convex in the unloaded state of the seat cushion.

9. The seat cushion according to claim 8, wherein the seat surface wall area is more convex than the bottom surface wall area.

10. The seat cushion according to claim 1, wherein the bottom surface wall area in the area of the supports is elongated by flat, sickle-shaped wall areas toward the transition wall area.

11. The seat cushion according to claim 1, wherein the bottom surface wall area is convex in an unloaded state of the seat cushion.

12. The seat cushion according to claim 2, wherein the distance of the transition wall area from the middle of the seat cushion increases in the area of the supports from two sides up to a maximum in the middle of the supports.

* * * * *